US007185376B2

(12) United States Patent
Brown

(10) Patent No.: US 7,185,376 B2
(45) Date of Patent: Mar. 6, 2007

(54) SINK CLIP

(76) Inventor: Joseph Brown, 23 Webster Ave., Pelham, NH (US) 03076

( * ) Notice: Subject to any disclaimer, the term of this patent is extended or adjusted under 35 U.S.C. 154(b) by 0 days.

(21) Appl. No.: 10/642,777

(22) Filed: Aug. 18, 2003

(65) Prior Publication Data

US 2005/0039254 A1 Feb. 24, 2005

(51) Int. Cl.
*E03C 1/33* (2006.01)
*A47B 97/00* (2006.01)

(52) U.S. Cl. ..... 4/633; 4/634; 248/500; 403/397

(58) Field of Classification Search ..... 4/631–635; 312/140.4; 403/329, 397; 248/200.1, 201, 248/205.1, 212, 500, 510
See application file for complete search history.

(56) References Cited

U.S. PATENT DOCUMENTS 3,034,144 A * 5/1962 Lyon ..... 4/634
3,071,780 A * 1/1963 Lyon, Jr. ..... 4/633
3,095,580 A * 7/1963 Just ..... 4/633
4,016,608 A * 4/1977 Khan ..... 4/633
5,664,265 A * 9/1997 Gotter et al. ..... 4/634
6,793,190 B2 * 9/2004 White et al. ..... 4/633

* cited by examiner

*Primary Examiner*—Tuan Nguyen
(74) *Attorney, Agent, or Firm*—Bourque and Associates

(57) ABSTRACT

A mounting clip for securing a sink within an opening in a countertop having at least one side includes a body portion adapted to be secured to the sink and a flexible sink engagement section. The flexible sink engagement section includes a first and a second section. The first section is disposed proximate a first end of the body portion at an angle A1 relative to the body portion. The second portion is disposed at an angle A2 relative to the first section and includes a tip adapted to engage a substantially vertical face of the countertop opening. When the sink is secured in the countertop opening, the tip frictionally engages the sides of the countertop opening. The mounting clip may include a fastener for securing the clip to a mounting channel disposed on the sink, or alternatively may be secured directly to the sink.

5 Claims, 5 Drawing Sheets

SINK CLIP

TECHNICAL FIELD

The present invention relates to counter top mounting clips and more particularly, to counter top mounting fasteners for over-the-counter sinks.

BACKGROUND INFORMATION

There are several known methods of securing a sink to a counter top depending upon the circumstances, where the sink is to be mounted, and the type of sink, for example, an over-the-counter or under-the-counter sink. Traditionally, over-the-counter sinks 10, FIG. 1, are secured to the counter top 12 using a mounting clip 14 which is disposed within a channel 22 in a lip portion 24 of the sink 10. The mounting clip 14 generally includes a threaded fastener 16 having a head portion 18 and a counter top engaging portion 20. The head portion 18 is generally sized to fit within the channel 22 disposed along the lip portion 24 of the sink 10.

To mount the sink 10 to the counter top 12, the user first places the sink 10 within an opening 26 in the counter top 12. Next, the user inserts the head portion 18 of one or more clips 14 within the channel 22. The counter top engagement section portion 20 includes a tip portion 28 which engages the bottom surface 30 of the counter top 12. The user secures the sink 10 to the counter top 12 by then rotating the threaded aperture 16 until the counter top engagement portion 28 and in particular the tip 28 is tight and the sink 10 is secure.

The known method of securing an over-the-counter sink 10 to a counter top 12 suffers from several limitations. For example, the mounting clips 14 must be inserted into the channel 22 once the sink 10 has been placed within the aperture 26 in the counter 12. This can be difficult especially when the channel 22 is in a difficult place to reach, for example along a back wall.

Another problem with the known method results from the variations among the thickness of the counter top 12. For example, referring specifically to FIG. 2, when the depth D of the counter top 12 is larger than the distance A between the clip engagement tip 28 and the lip 24 of the sink 10, a cavity 32 must be drilled into the counter top 12 prior to placing the sink 10 within the aperture 26 in the counter top 12. This greatly increases the amount of labor necessary to install the sink 10 because it adds additional steps to the mounting process. Additionally, drilling the cavities 32 can be difficult especially depending upon the type of material which the counter top 12 is made from and the circumstances of the installation, for example the location and proximity of walls, pipes, electrical lines, equipment, etc. Also, the cavities 32 must be created prior to installing the sink 10 and the user must align the clips into the cavity 32 which can be difficult especially in tight places. Furthermore, the counter top 12 may not be large enough to drill into and create the cavities 32.

Accordingly, what is needed is a sink clip that can be attached to the sink prior to installing the sink within the opening of the counter top. Additionally, the clip should work with a wide variety of counter top thicknesses and should not require drilling cavities into the counter top.

SUMMARY

The present invention features a mounting device used for mounting a sink within an opening in a countertop having at least one side. The mount includes a body portion and a flexible sink engagement portion. The body portion is adapted to be secured to the sink. According to one embodiment, the body portion is molded, glued, welded, an integral part thereof, or otherwise secured to the sink in any way known to those skilled in the art.

Alternatively, the body portion may include a channel engagement section dispose proximate a second end of the body portion. The channel engagement section preferably includes a substantially horizontal portion secured to the second end of the body portion and a substantially vertical portion disposed proximate an end of the substantially horizontal portion. The substantially horizontal and vertical portion are sized and shaped to engage an outside surface of a channel on the countertop.

The flexible sink engagement section includes a first section and a second section. The first section is disposed proximate a first end of the body portion at an angle A1 relative to the body portion. The second portion is disposed at an angle A2 relative to the first section and includes a tip adapted to engage the side of the countertop opening. When the sink is inserted within the countertop opening, the angles A1 and A2 are reduced and the tip digs into or otherwise prevents the sink from being removed. Angles A1 and A2 are preferably between about 30 and about 60, preferably 45 degrees and between about 15 and about 30, preferably 22 degrees respectively.

The mount may optionally include a fastener having a head disposed proximate a first end and a threaded region. The head of the fastener is sized and shaped to fit within the channel on the countertop. The fastener may threadably engage an aperture within the substantially horizontal portion. Alternatively, the fastener further includes a nut wherein the fastener threadably engages the nut. The fastener may also include a slot disposed proximate a second end for rotating the fastener.

The flexible sink engagement section may also include a substantially horizontal section having a second aperture adapted to accept the fastener and a first end disposed proximate the first end of the body portion. The first section of the flexible engagement section is disposed proximate a second end of the substantially horizontal section at the angle A1 relative to the body portion.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
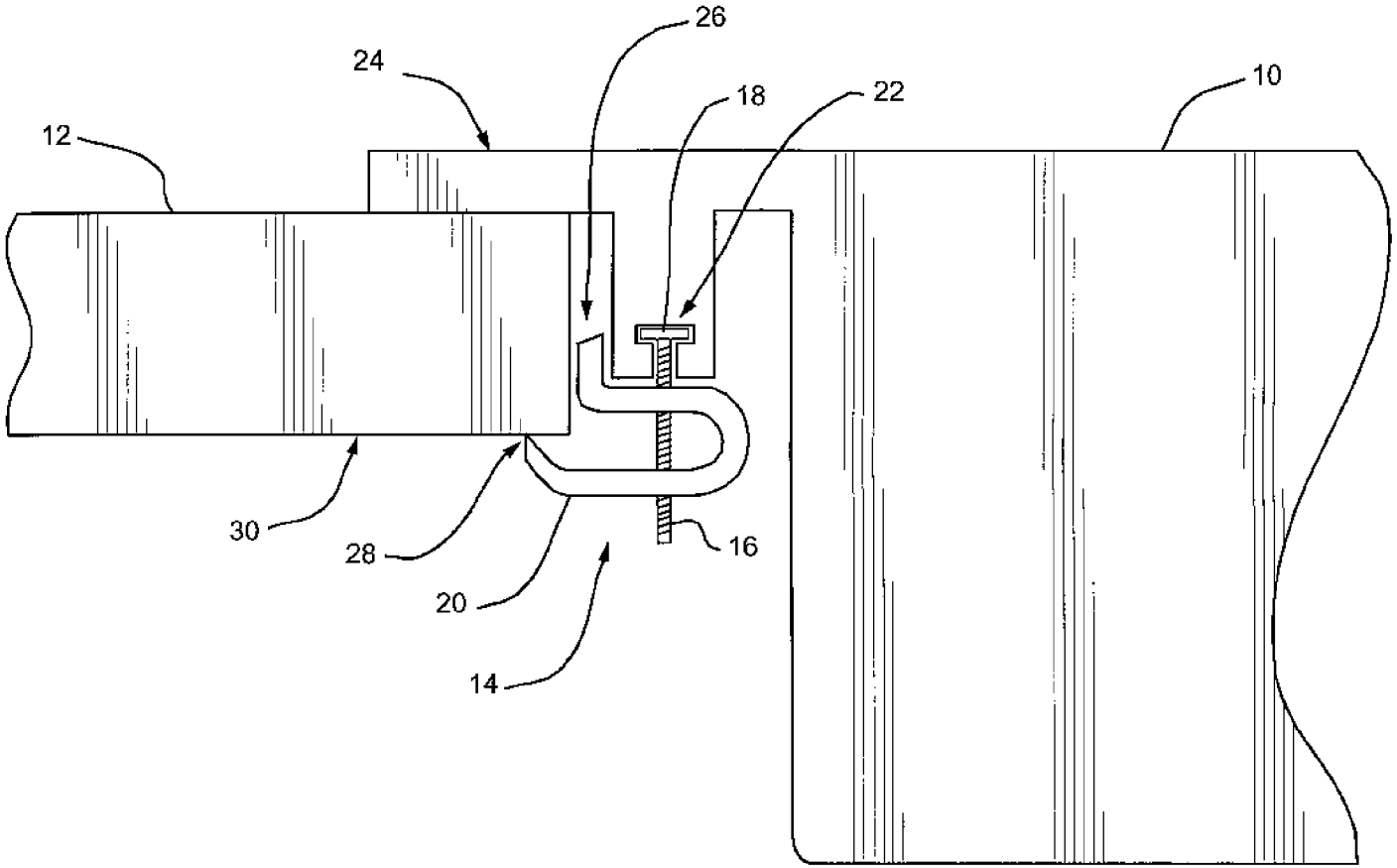
FIG. 1 (PRIOR ART)
FIG. 1 is a side view of one embodiment of the prior art.
Figure 2:
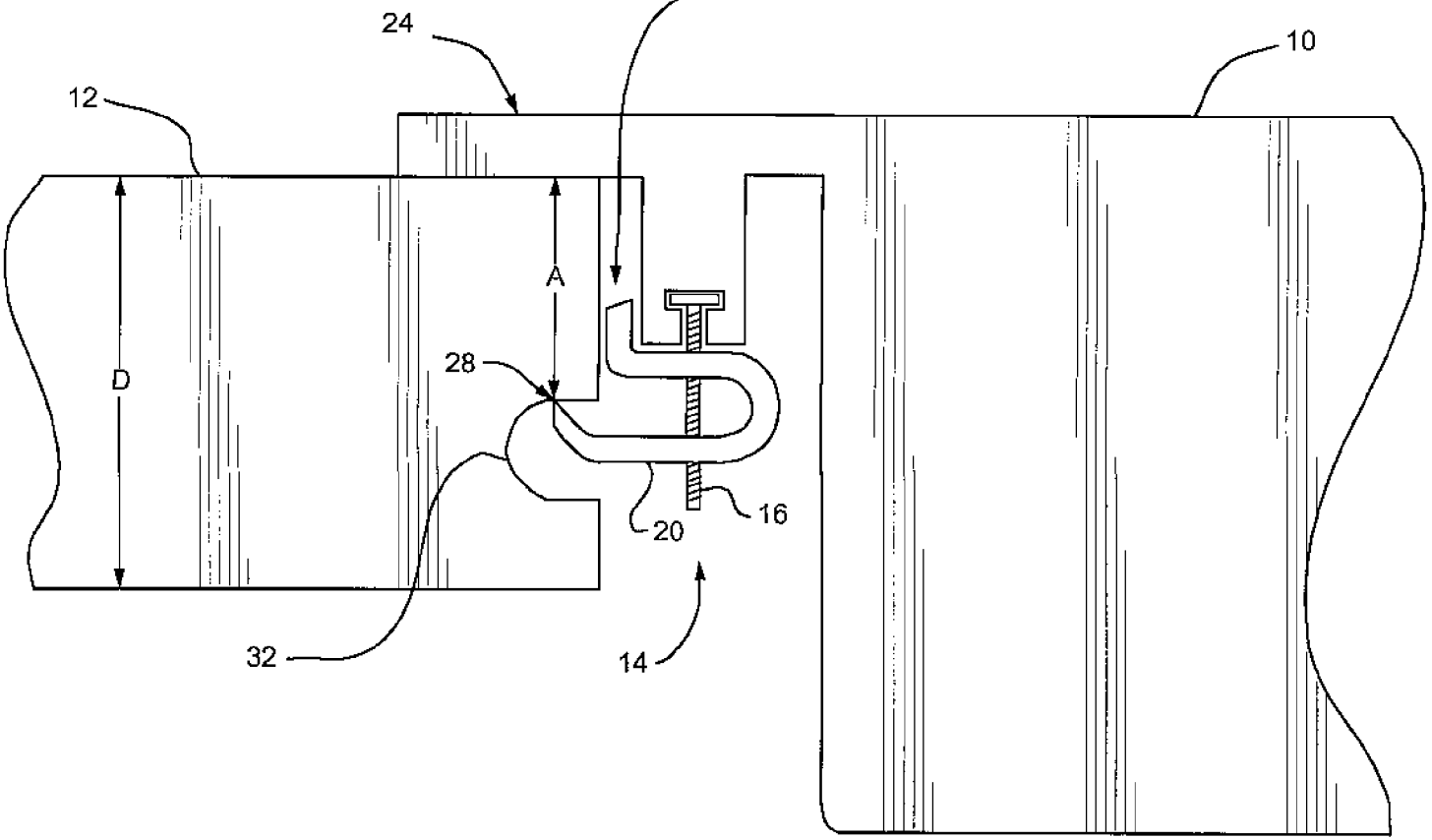
FIG. 2 (PRIOR ART)
FIG. 2 is a side view of another embodiment of the prior art.
Figure 7:
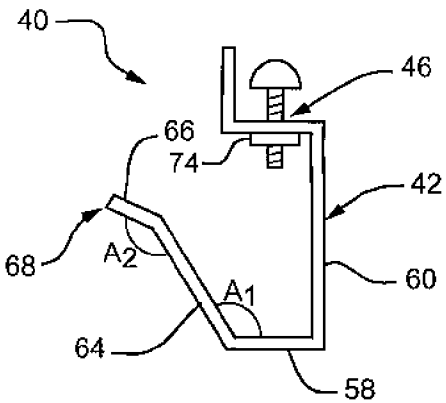
FIG. 7 is a side view of yet another embodiment according to the present invention.
Figure 3:
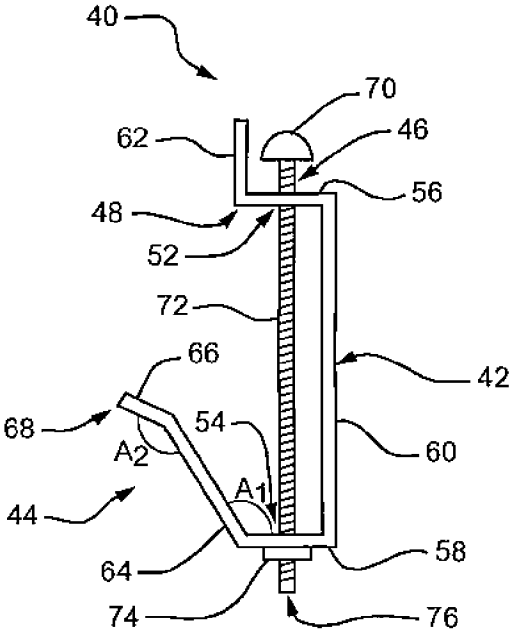
FIG. 3 is a side view of one embodiment of the mounting device according to the present invention.
Figure 4:
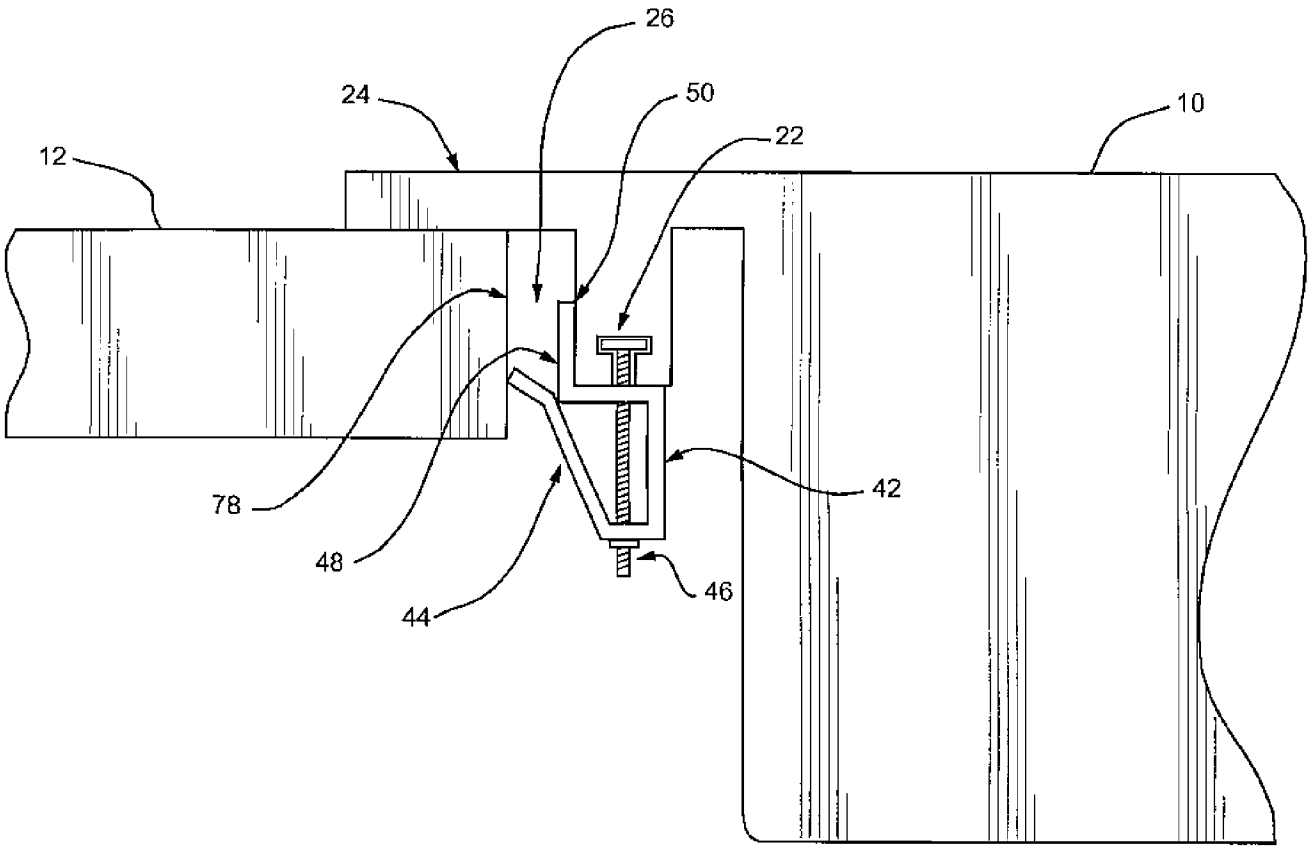
FIG. 4 is a side view of the embodiment shown in FIG. 3 of the present invention in combination with a sink and a counter top.

The mounting device 40, FIGS. 3, 4, and 7, according to the present invention, is used to secure a sink 10, preferably an over-the-counter sink, to a counter top 12. The clip 40 includes a body 42, a flexible sink engagement portion 44, and a fastener 46.

According to one embodiment, the body 42 includes a channel engagement section 48 which is sized and shaped to engage the outside surface 50 of a channel 22 disposed on the lip 24 of the sink 10. The body 42 also preferably includes a first and second aperture 52, 54 which is sized and shaped to accept the fastener 46. In the preferred embodiment, one or more of the apertures 52 and 54 are threaded so as to engage the fastener 46. Alternatively, a nut 74 may be provided to engage the fastener 46 as will be described in greater detail hereinbelow.

The apertures 52 and 54 are preferably located in a first and second fastener region 56, 58 disposed at an angle, preferably about 90 degrees, relative to a longitudinal portion 60. In the preferred embodiment, the channel engagement section 48 also includes a generally vertical portion 62 which engages an outside surface 50 of the channel 22 to prevent the mount 40 from rotating as shown in FIG. 4 and described in greater detail hereinbelow.

The flexible sink engagement portion 44 includes a biasing region 64 disposed at an angle A1 relative to the body 42 and a tip portion 66 disposed at an angle A2 relative to the biasing region 64. According to the preferred embodiment, the angle A1 is between about 30 to approximately 60, preferably about 45°. The angle A2 is between about 15 to approximately 30, preferably about 22°. The tip portion 66 preferably includes a tip 68 which may include either a blunt or a sharpened tip region designed to engage the side 78 of the opening 26 in the counter top 12.

The fastener 46 preferably includes a head 70 a shaft 72 and optionally a nut 74. The head 70 is sized and shaped to fit within the channel 22 on the sink 10 and may be a round head, a squared head, a hexagonal head, or any other shape known to those skilled in the art. Depending on the method to tighten the fastener 46, the head 70 may be sized and shaped to prevent the fastener 46 from rotating or alternatively to allow the fastener 46 to rotate and is within the knowledge of one of ordinary skill in the art.

The shaft 72 preferably includes a threaded portion for engaging either the first and/or second aperture 52, 54 (in the embodiment wherein the apertures 52, 54 are threaded) or the nut 74. The shaft 72 may optionally include a slot 76 or other means disposed on the end of the shaft 72 to allow the fastener 46 to be rotated and to tighten the body 42 relative to the channel 22 as will be described in greater detail hereinbelow.

Referring specifically to FIG. 4, to install the sink 10 within the opening 26 in the counter top 12, the user first inserts the head 70 of the fastener 46 of one or more mounts 40 within the channel 22 on the lip 24 of the counter top 12. To prevent the mounts 40 from moving prior to installing the sink 10, the vertical portion 62 of the channel engagement section 48 is preferably proximate the outside surface 50 of the channel 22 and the first fastener region 56 is preferably proximate the bottom of the channel 22. Next, the user tightens the fastener 46 which moves the first fastener region 56 into contact with the channel 22. According to one embodiment, the user tightens the fastener 46 by rotating the nut 74 which threadably engages the shaft 72 causing the body portion 42 to be drawn closer to the bottom of the channel 22. Alternatively, the user may rotate the shaft 72 of the fastener 46 using the slot 76.

Once the mounts 40 are secure within the channel 22, the user then simply inserts the sink 10 within the opening 26 in the counter top 12. As the sink is inserted within the opening 26, the tip 68 of the flexible sink engagement portion 44 contacts the sides 78 of the counter top 12, thus bending the flexible sink engagement portion 44 and reducing the angles A1 and A2. Once in place, the tip 68 directly engages the sides 78 of the counter top, and preferably digs into the sides 78 thus preventing the sink 10 from being removed from the opening 26 and the counter top 12. Caulking and/or other sealants may also be used as is well known to those skilled in the art.

Securing the mounts 40 to the sink 10 prior to installing the sink 10 within opening 26 in the counter top 12 greatly simplifies the installation process because it is much easier to secure the mounts 40 to the sink 10 while the sink 10 is not in the opening 26 in the counter top 12. Additionally one skilled in the art will recognize that the mounts 40 according to the present invention will work with a wide variety of counter top 12 thickness, and thus do not require drilling cavities in the counter top 12.

Figure 5:
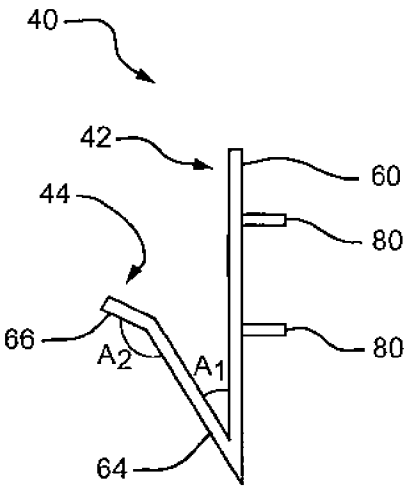
FIG. 5 is a side view of another embodiment of the present invention.
Figure 6:
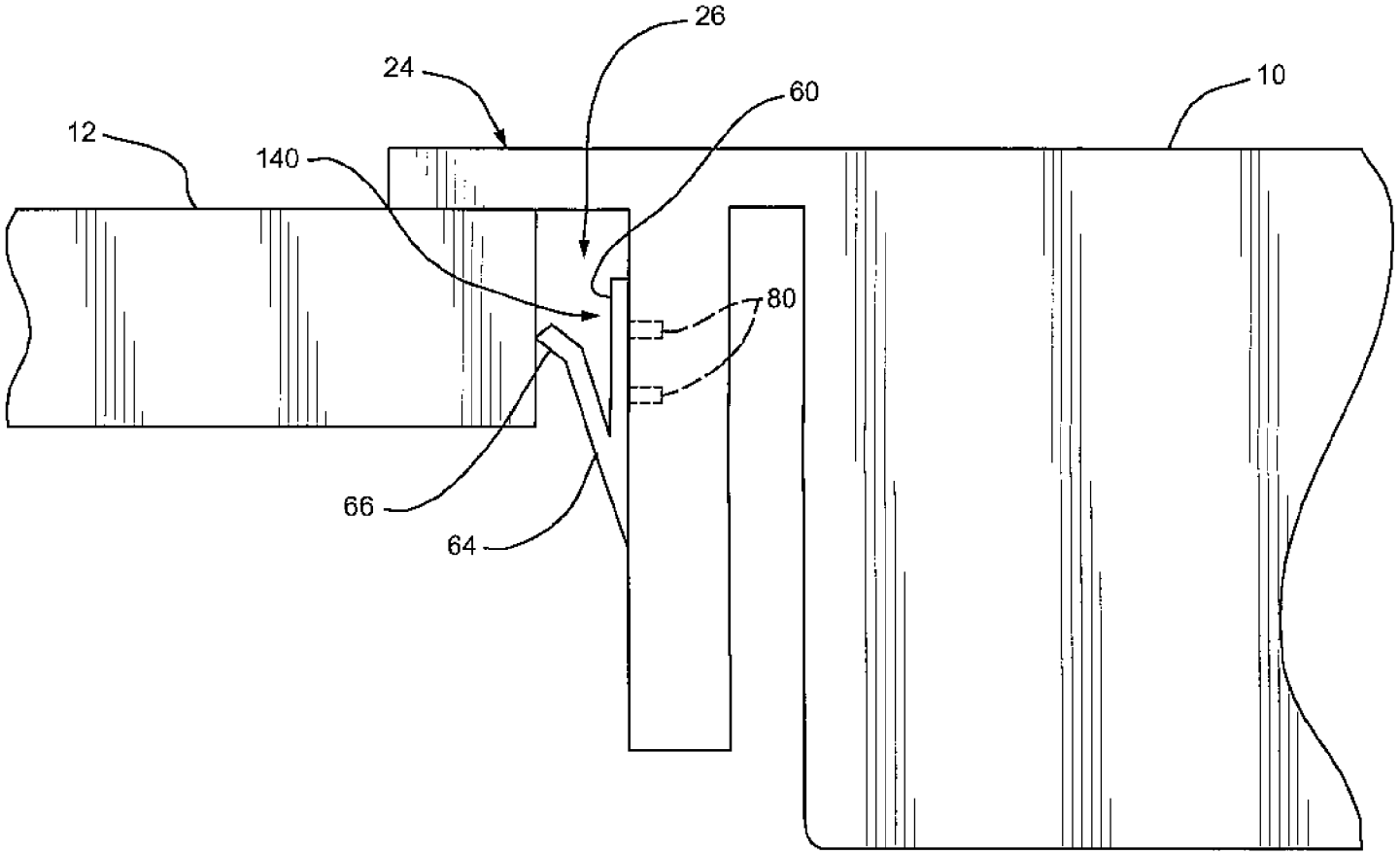
FIG. 6 is a side view of the embodiment shown in FIG. 5 of the present invention in combination with a sink and a counter top.

According to another embodiment, the mount 140, FIGS. 5 and 6, includes a longitudinal portion 60 which is adapted to be secured directly to the sink 10. The mount 140 includes a biasing region 64 disposed at an angle A1 relative to the longitudinal portion 60 and a tip portion 66 disposed at an angle A2 relative to a biasing region 44 as previously described. According to this embodiment, the longitudinal portion 60 may be secured to the sink 10 using one or more fasteners 80 such as screws, rivets or bolts. Alternatively, the longitudinal portion 60 may be molded integrally into the sink 10 or secured to the sink 10 using an adhesive or otherwise secured to the sink 10 by any means known to those skilled in the art.

Modifications and substitutions by one of ordinary skill in the art are considered to be within the scope of the present invention, which is not to be limited except by the following claims.

The invention claimed is:

1. A mount for securing a sink within an opening in a countertop, said mount comprising:

a body portion including:

a leg segment having a first longitudinal axis and proximal and a distal ends disposed at generally opposite ends of said leg segment, a lip segment having a second longitudinal axis disposed substantially parallel to said first longitudinal axis and a proximal and a distal end disposed along generally opposite ends of said lip segment;

a first base segment having a third longitudinal axis, wherein said proximal end of said lip segment is secured to said base segment such that said third longitudinal axis is disposed substantially perpendicular to said first and second longitudinal axes, wherein said first base segment includes a proximal and a distal end disposed along generally opposite ends of said first base segment, and wherein said lip segment is secured to said proximal end of said first base segment and a proximal end of said leg segment is secured to said distal end of said first base segment such that said leg segment is disposed substantially parallel to said lip segment; and a second base segment having a fourth longitudinal axis, wherein a distal end of said leg segment is secured to a first end of said second base segment such that said fourth longitudinal axis of said second base segment is disposed substantially parallel to said third longitudinal axis of said first base segment;

means for securing said body portion to said sink prior to installation of said sink in said countertop opening; and a flexible sink engagement section including:

a first portion having a first end secured to a second end of said second base segment of said body potion; and a second portion having a first end secured to a second end of said first portion, said second portion having a tip adapted to engage a substantially vertical face of said countertop opening when said sink is disposed within said countertop opening, wherein said flexible sink engagement section is configured to directly and deflectably engage against said vertical face of said countertop opening such that said flexible sink engagement section is disposed at a first angle relative to said fourth longitudinal axis of said second base segment when in an uninstalled position and is disposed at a second angle relative to said fourth longitudinal axis of said second base segment when in said installed position, wherein said second angle is less than said first angle.

2. The mount as claimed in claim 1 wherein said means for securing includes:

a first aperture disposed through said first base segment; and a fastener disposed through said first aperture, said fastener having a head portion adapted to engage a sink channel.

3. The mount as claimed in claim 2 wherein said means for securing further includes a second aperture disposed through said second base segment, wherein said fastener is disposed through said first and said second apertures in said first and second base segments respectively.

4. The mount as claimed in claim 1 wherein said first portion of said flexible sink engagement section is disposed at an angle (Al) relative to said second base segment wherein said angle (Al) is between about 120 and about 150 degrees in said unbiased position.

5. The mount as claimed in claim 1 wherein said second portion is disposed at an angle (A2) relative to said first portion, wherein said angle (A2) is between about 105 and about 120 degrees in said unbiased position.

* * * * *